US006310532B1

(12) United States Patent
Santa Cruz et al.

(10) Patent No.: US 6,310,532 B1
(45) Date of Patent: Oct. 30, 2001

(54) MULTIPURPOSE MAGNETIZER/ DEMAGNETIZER

(76) Inventors: Cathy D. Santa Cruz, 7630 Tholl Dr., Reno, NV (US) 89506; Gregory L. Henry, 1855 Baring Blvd., #1803, Sparks, NV (US) 89434; Neil R. Alderson, 5370 Santa Anita Dr., Sparks, NV (US) 89436

( * ) Notice: Subject to any disclaimer, the term of this patent is extended or adjusted under 35 U.S.C. 154(b) by 0 days.

(21) Appl. No.: 09/574,908

(22) Filed: May 19, 2000

(51) Int. Cl.[7] ..... H01F 13/00
(52) U.S. Cl. ..... 335/284; 81/451
(58) Field of Search ..... 335/284; 81/437, 81/490, 125, 451; 561/142–3, 149, 267; 336/66

(56) References Cited

U.S. PATENT DOCUMENTS

| | | | | |
|---|---|---|---|---|
| 1,849,085 | * | 3/1932 | Haskins | 335/184 |
| 3,772,686 | * | 11/1973 | Chadron | 340/378 |
| 3,922,687 | * | 11/1975 | Trimble et al. | 346/74.01 |
| 4,716,796 | * | 1/1988 | Corona et al. | 81/439 |
| 5,055,813 | * | 10/1991 | Johnson | 335/284 |

* cited by examiner

*Primary Examiner*—Lincoln Donovan

(57) ABSTRACT

A magnetizer/demagnetizer which includes an elongated receptacle for slidably receiving an elongated tool therein, irrespective of length. Also, the magnetizer/demagnetizer includes unique accessory items, such as a tube for containment of small parts, and magnetism indicator means for indicating when a tool needs to be re-magnetized.

11 Claims, 4 Drawing Sheets

MULTIPURPOSE MAGNETIZER/ DEMAGNETIZER

FIELD OF THE INVENTION

The present invention relates to devices or apparatus's which are specifically used for magnetizing or demagnetizing ferromagnetic objects, such as tools. However, the present invention more particularly pertains to such a device that may be used for multiple purposes and can accept different sized objects. Also the device may include a tubular shaped container for containment of small specialty items, such as those typically used by jewelers, or the like.

BACKGROUND OF THE INVENTION

Within the known prior art, many attempts have been made to provide a device which may be used for magnetizing or demagnetizing ferrous members, such as screwdrivers, or the like. However, each have inherent disadvantages which the present invention addresses and overcomes in a manner heretofore not taught. For example, U.S. Pat. No. 5,055,813 entitled "MAGNETIZATION/ DEMAGNETIZATION DEVICE", teaches a portable device which may be used for tools, etc. But this device is very limited, as it provides a single opening which will only accept a standard, or smaller sized screwdriver, and therefore is not functional for other types of tools.

Other examples include U.S. Pat. No. 3,467,926, entitled "COMBINED MAGNETIZER AND DEMAGNETIZER" and U.S. Pat. No. 3,662,303 entitled "INSTANT MAGNETIZER AND DEMAGNETIZER", which again are only functional for a standard, or smaller sized screwdrivers.

Each of the above devices are functional for use with screwdrivers and are advantageous because they are portable and compact. Unfortunately they are not electric, and are therefore very weak, thus a user must repeatedly engage the magnetizing or demagnetizing process every few days. This is both time consuming and most irritating for the user and further interferes with productivity, which can be costly.

Other types of demagnetizing devices include U.S. Pat. No. 4,158,873 entitled "DEMAGNETIZING METHODS AND APPARATUS" and U.S. Pat. No. 4,829,397 entitled "APPARATUS FOR DEMAGNETIZING PARTS". These two references are strictly used for demagnetizing, they are much too complicated and include parts which the present invention eliminates. Also these devices will not allow a user to insert an object which is to be demagnetized into and throughout the receptacle of the device.

SUMMARY OF THE INVENTION

It is therefore an object of the present invention to provide a multipurpose magnetizer/demagnetizer that overcomes the known disadvantages associated within the prior art.

Another object of the present invention is to provide a multipurpose magnetizer/demagnetizer which is very powerful, durable, of simple construction, and is economical to manufacture and affordably priced for the consumer.

Still another object of the present invention is to provide a multipurpose magnetizer/demagnetizer which is not limited to use with a specific tool, such as a screwdriver or the like, and can accept elongated objects irrespective to a any specific length. This is a very important object as some specialty tools, such as screwdrivers that include removably interchangeable tips, also have a large bulging permanent magnet built inside of the shaft which will not fit into the receptacles typically provided within the prior art.

Also another object of the present invention is to provide a multipurpose magnetizer/demagnetizer which is normally referred to as a bench-top and is powered by typical voltage, such as 110–120 volts AC.

Yet another object of the present invention is to provide a multipurpose magnetizer/demagnetizer which includes various safety features.

Still another object of the present invention is to provide a multipurpose magnetizer/demagnetizer that includes at least one on/off switch which totally disconnects the device 100% from the power source when not in use, at least one magnetize/demagnetize switch, and at least one indicator light.

A further object of the present invention is to provide a multipurpose magnetizer/demagnetizer that allows the user to either fully or only partially magnetize or demagnetize an object of choice, according to the user's individual needs.

Yet another object of the present invention is to provide a multipurpose magnetizer/demagnetizer having an elongated circular receptacle that will accept an accessory item such as a non-conducting tubular shaped container. With the container being used for containment of small parts, such as watch parts, which require demagnetizing periodically, or the like.

Also an object of the present invention is to provide a multipurpose magnetizer/demagnetizer which may include an accessory item such as a metal strip, or a separate tubular member which is used to indicate magnetism strength of the tool, and thus notifies the user when the tool needs to be re-magnetized.

Still another object of the present invention is to provide a multipurpose magnetizer/demagnetizer that is very simple to use and is of durable construction.

A further object of the present invention is to provide a multipurpose magnetizer/demagnetizer which when a tool has been magnetized, the tool will remain in the treated condition a longer period of time than when subjected to treatment by the known prior art. For example, a tool when subjected to a typical non-electric magnetizer/demagnetizer will remain in the magnetized condition for approximately 3 days. While a tool when subjected to treatment by the present invention will remain in the magnetized condition for approximately 3 months, as long as the tool is not subjected to extraordinary impacts or heat, and this is very advantageous.

DETAILED DESCRIPTION OF THE DRAWINGS

Referring now in detail to the drawings wherein like characters refer to like elements throughout the various views.

Figure 1:
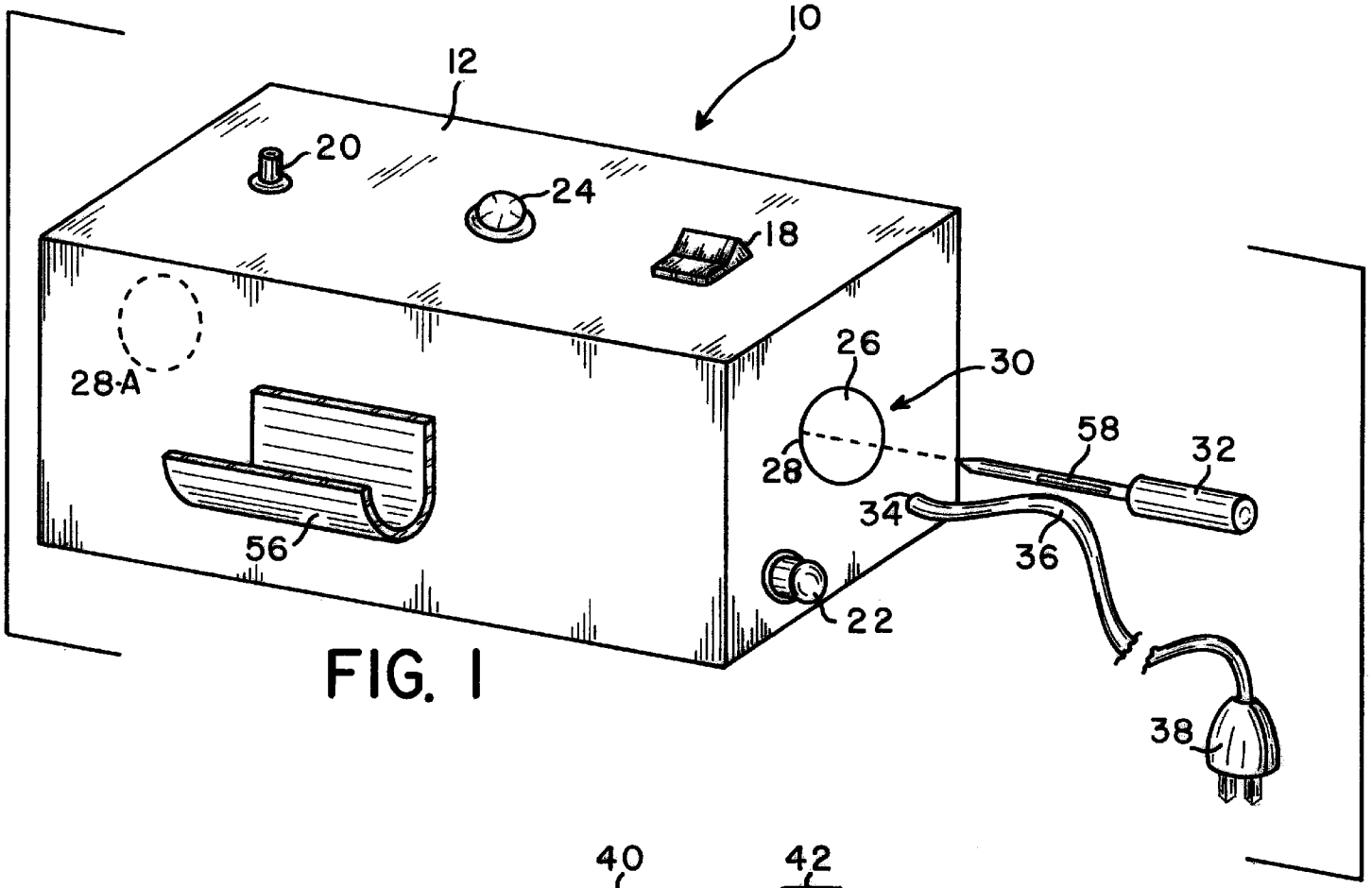
FIG. 1 is substantially a perspective view of the preferred embodiment for the present invention.
Figure 2:
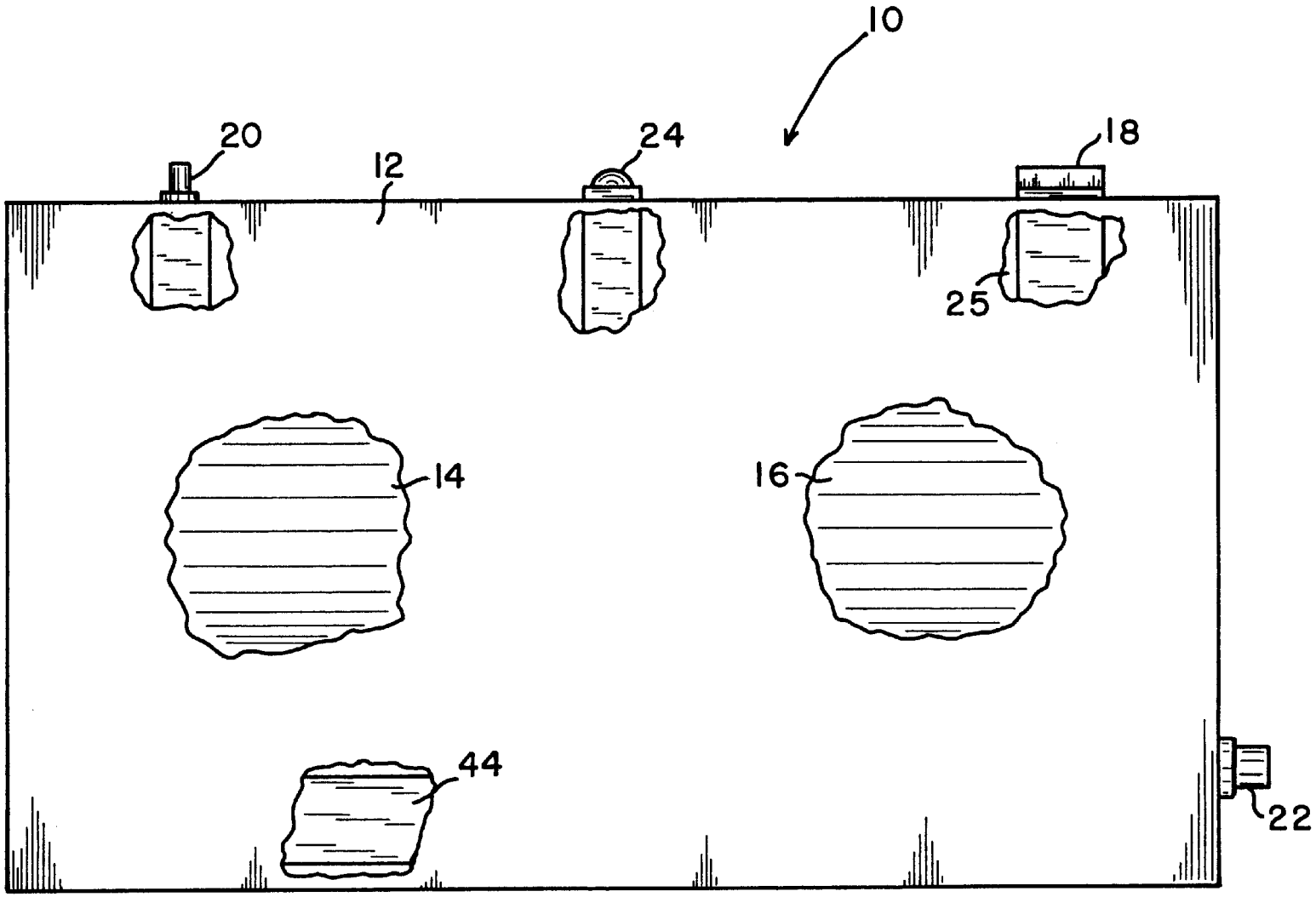
FIG. 2 is substantially a partial plan view showing internal location of components.

In FIGS. 1 & 2, (10) substantially represents an overview of the present invention which is a multipurpose magnetizer/ demagnetizer that is used for magnetizing or demagnetizing ferromagnetic tools. Magnetizer/demagnetizer (10) is formed from a housing (12) which is made from substantially any suitable material of engineering choice, such as plastic, acrylic, or the like. Also, housing (12) can be of any suitable shape or size of engineering choice, such as 170 mm in length, by 105 mm wide, by 105 mm high.

Magnetizer/demagnetizer (10) as depicted in FIG. 2, further includes a first coil (14), a second coil (16), an AC/DC rocker switch (18), an on/off push switch (20), a safety fuse (22), and an indicator light (24).

Referring now to first coil (14) and second coil (16), which are arranged stacked in series in a manner where both coils (14 & 16) in combination create a synchronized magnetic field in the same direction. It is to be understood each coil (14 & 16) can be any suitable type of coil of engineering choice. Such as each coil (14 & 16) may be made from physically series stacked, electrical wired parallel coil wire single strand, 32 AWG, enamel glazed single strand wire approximately 4,600 feet. With each coil (14 & 16) substantially measuring 18 mm inside diameter by 40 mm outside diameter and 78 mm in length.

As depicted in FIGS. 1 & 2, it can clearly be seen safety fuse (22), indicator light (24), and each switch (18 & 20) are surface mounted at a location of engineering choice onto housing (12).

It is to be understood housing (12) forms an internal cavity (25) as illustrated in FIG. 2, for containment of each coil (14 & 16) and other electrical interconnected components. Such electrical components include typical electrical lead lines, 4 diodes which when interconnected form a bridge rectifier circuit 400 v/4 amps, and a diode circuit which forms an inductive kick surge suppressor. Each of which will be addressed within the specification referring to FIG. 4, describing the schematic overview.

Within FIG. 1, it can clearly be seen that first coil (14) and second coil (16) in combination form a central elongated opening (26) and housing (12) has two opposing openings (28-A) and (28-B). Thus, central elongated opening (26) and two opposing openings (28-A) and (28-B) in combination, form an elongated circular receptacle (30) for receiving a tool (32) therein. Also, housing (12) has a hole (34) for containment of a typical electrical wire (36) with associated wall plug (38).

Figure 3:
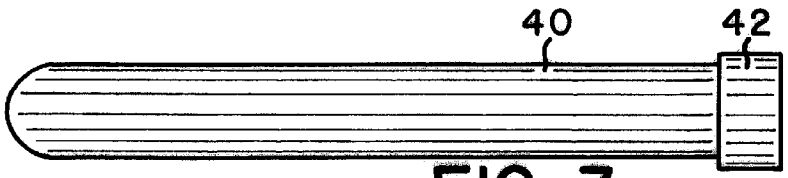
FIG. 3 is substantially a side view of an accessory item.

It is to be noted in many cases, a user may wish to magnetize, partially magnetize or demagnetize very small objects, such as those typically used by jewelers or the like. Unfortunately, such objects due to their miniscule size, can be easily accidentally drawn into the receptacle due to the magnetic pull, or the object could be propelled outwardly therefrom in a dangerous manner. This is very frustrating and the user must then turn the device off, overturn the magnetizer/demagnetizer, and manually retrieve the object. Therefore, in order to overcome this inherent enigma, we provide an accessory item in the form of a non-conductive tube (40) which is of a shape and size to be slidably engaged within elongated circular receptacle (30). Tube (40) further having a removable cap (42), as depicted in FIG. 3. Thus, the user can easily remove cap (42) from tube (40), insert the object within tube (40), replace cap (42), insert tube (40) containing the object into the receptacle (30), and magnetize or demagnetize the object without accidental loss.

Figure 4:
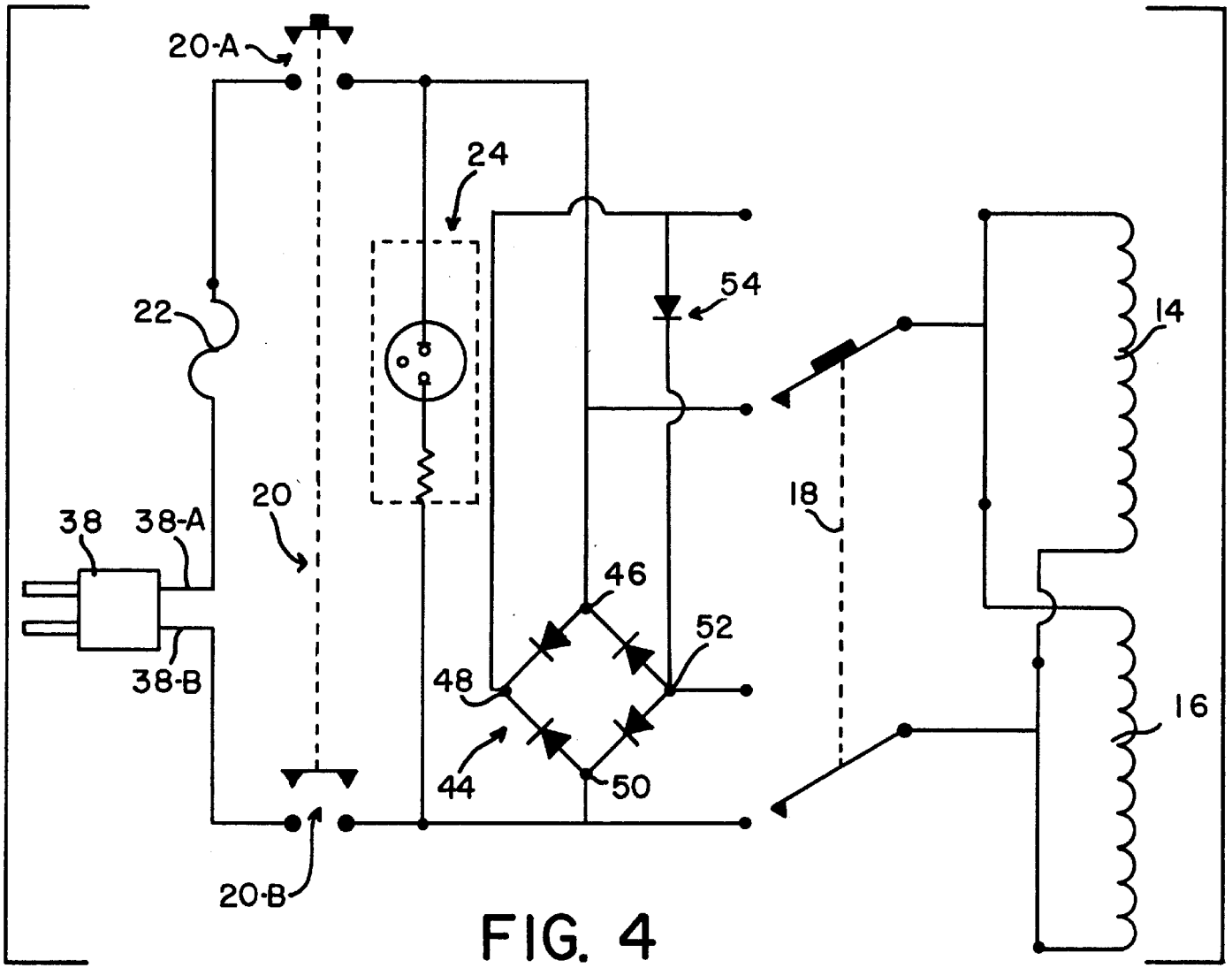
FIG. 4 is substantially a schematic overview for the present invention.

Referring now to the schematic overview as depicted in FIG. 4, whereby we will now describe the previously noted electrical interconnected components as follows.

Plug (38) being a typical 115 VAC 15 amp wall plug having a first lead line (38-A) and a second lead line (38-B), with lead line (38-A) being connected to safety fuse (22). It is to be noted any suitable type of safety fuse of engineering choice may be used, such as safety fuse (22) may be a 120 VAC/5 amp. It is to be noted this is an important safety feature of the present invention, as safety fuse (22) will blow if subjected to a power surge or if the magnetizer/demagnetizer becomes too hot or malfunctions.

First lead line (38-A), second lead line (38-B) and safety fuse (22) being electrically connected to on/off switch (20), which can be any suitable on/off switch of engineering choice, such a momentary single throw/double pole 4 amp.

It will now be seen when on/off switch (20) is in an up position, the electrical circuit is not complete, thus the magnetizer/demagnetizer is off. Whereas when on/off switch (20) is manually pressed into a down position, the electrical circuit is energized, thus the magnetizer/demagnetizer is on. This is another important safety feature as this eliminates the user accidentally leaving the magnetizer/demagnetizer on when not in use.

On/off switch (20) being connected to indicator light (24), whereby, when on/off switch (20) is held in the down position the electrical circuit is activated and indicator light (24) illuminates, thus notifying the user that magnetizer/demagnetizer is functional and operating. It is to be understood any suitable type of indicator light of engineering choice may be used. Such as indicator light (24) may be a neon lamp/resister package powered by 115 VAC.

On/off switch (20) being connected to a 4 AMP/400 volt bridge rectifier circuit (44) with bridge rectifier circuit (44) having a first diode (46), a second diode (48), a third diode (50) and a fourth diode (52).

Bridge rectifier circuit (44) being connected to AC/DC rocker switch (18), which again can be any suitable type of rocker switch of engineering choice. Such as rocker switch (18) may be a double pole double-throw 115 volts 4 amp having a first position and a second position, and rocker switch being connected to first coil (14) and second coil (16).

As an additional feature of the present invention, we further include a DC power off inductive kick surge suppressor (54), which is connected reverse bias to second diode (48) and fourth diode (52). Whereby, when magnetizer/demagnetizer is shut off, the collapsing electromagnetic field is effectively more rapidly reduced. Therefore, canceling the residual coil feed back from reducing the initial magnetism of the tool after treatment.

It will now be seen when on/off switch (20) is manually pressed down and AC/DC rocker switch (18) is in its first position, on/off switch (20), AC/DC rocker switch (18) and coils (14 & 16) are energized. Whereby, creating an AC electromagnetic field which will demagnetize a tool (32) when positioned within receptacle (30).

It will further be seen when on/off switch (20) is manually pressed down and AC/DC rocker switch (18) is in its second position, on/off switch (20), bridge rectifier circuit (44), AC/DC rocker switch (18) and coils (14 & 16) are energized. Whereby, supplying DC current to coils creating a magnetizing field which will magnetize a tool (32) when positioned within receptacle (30).

It is to be further noted if desired, housing (12) may include a fixedly attached clip (56) which is of a shape and size to frictionally receive and mount tube (40) onto housing (12). It is to be understood any suitable type of attachment means of engineering choice may be used to attach clip (56) to housing (12), such as glue or the like.

The magnetizer/demagnetizer (10) may further include first magnetism indicator means for exhibiting magnetic strength of tool (32). For example, in FIG. 1, tool (32) includes a metal strip (58) that magnetically adheres to tool (32) when tool (32) is magnetized. Whereby, when tool (32) is no longer magnetized, metal strip (58) will automatically fall off and notify the user that tool (32) needs to be magnetized again. Also, metal strip (58) may be color coded and as the magnetism of tool (32) diminishes, the color of strip (58) will change, which again notifies the user that tool (32) needs to be magnetized. Such as the metal strip (58) may be coated with a paint having a molecular composition which changes color according to a magnetic field. Again it is to be understood any suitable type of magnetism indicator of engineering choice may be used.

Figure 5:
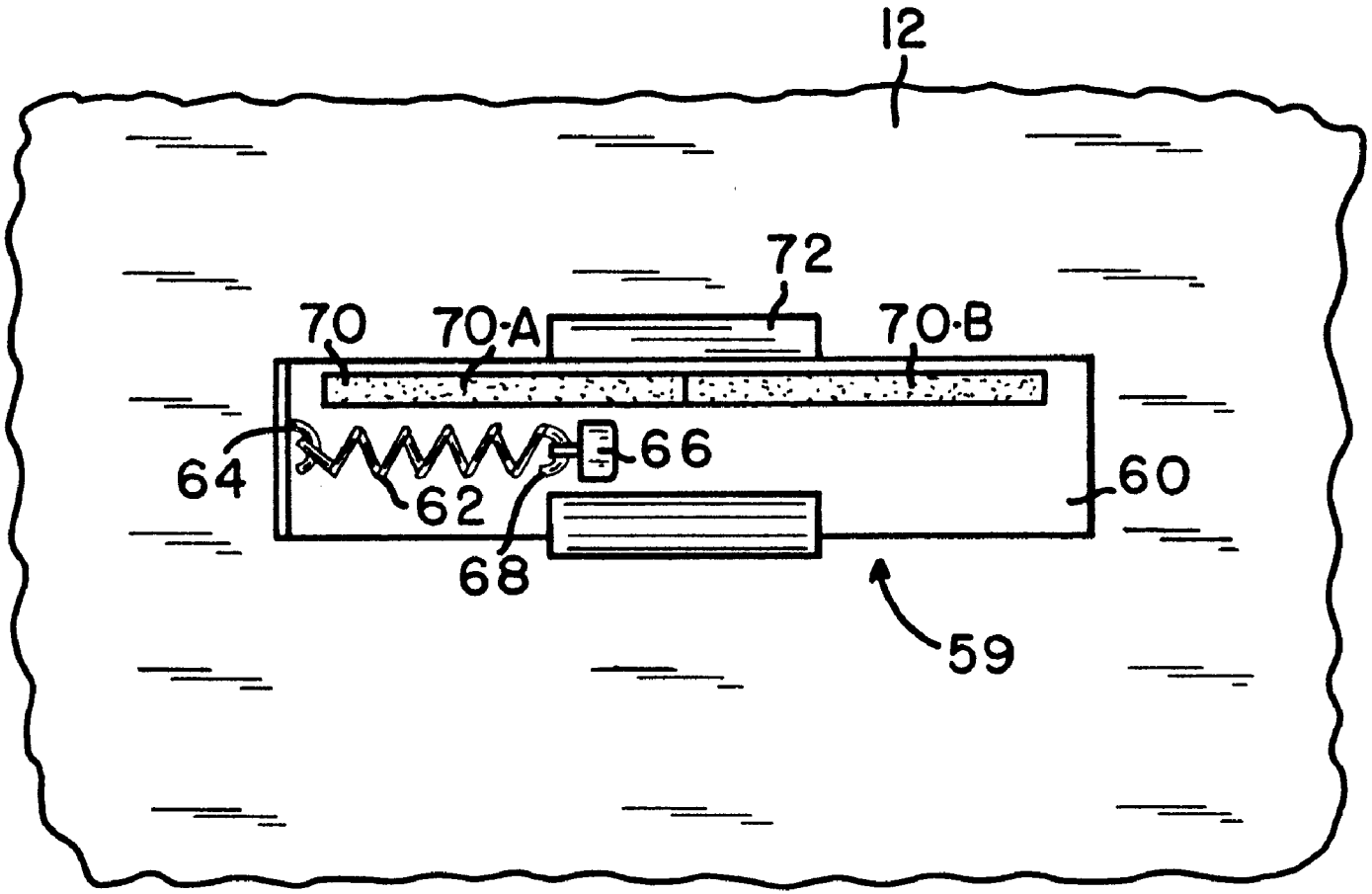
FIG. 5 is substantially an overview of another accessory item which is functional as a second magnetism indicator means for exhibiting magnetic strength of a tool.

In FIG. 5, is depicted yet another accessory item that is functional as a second magnetism indicator means for exhibiting magnetic strength of tool (32). For example, a second magnetism indicator (59) may be formed from a tubular housing (60) having a first end (60-A) and a second end (60-B) and is made from a non-conductive material of engineering choice, such as glass or plastic. First end (60-A) having attachment means for fixedly attaching a spring (62) thereon. Any suitable type of attachment means of engineering choice may be used for attaching spring (62) to first end (60-A). Such as glue, epoxy, etc. or as depicted in FIG. 5, a first hook member (64) is most functional. Spring (62) having a first end (62-A) and a second end (62-B). With first end (62-A) being fixedly attached to first end (60-A) of tubular housing (60) while second end (62-B) is fixedly attached to a metal slug (66). Again any suitable type of attachment means may be used of engineering choice for attaching second end (62-B) of spring (62) to metal slug (66), such as glue, epoxy, etc, or as depicted in FIG. 5, a second hook member (68) is very functional.

Housing (60) further having indicia (70) thereon for indicating magnetic strength. Any suitable type of indicia (70) of engineering choice may be used, such as a graph, lines, etc. or indicia (70) may be in the form of a color coded strip having a green zone (70-B) and red zone (70-A).

It will now be seen, when a tool (32) is positioned either inside or outside of the second end (60-B) of housing (60), the magnetic field of tool (32) attracts slug (66). Thus causing slug (66) and spring (62) to be urged or pulled toward second end (62-B) of housing (60). Whereby, a user can easily visually determine magnetic strength of tool (32) by comparing where slug (66) aligns on indicia (70). For example, when tool (32) is inserted into the second end (60-B) of housing (60) and slug (66) is only partially magnetically pulled, then slug (66) will substantially align within the red zone (70-A) on indicia (70), thus notifying the user the tool should be re-magnetized.

If however, tool (32) is inserted into the second end (60-B) of housing (60) and slug (66) is fully magnetically pulled, then slug (66) will substantially align within the green zone (70-B) on indicia (70), thus notifying the user the tool need not be re-magnetized.

It is to be understood if so desired, housing (12) may further include attachment means for removably attaching second magnetism indicator (59) onto housing (12). For example, housing (12) may include a clamp (72) which is of a shape and size to frictionally retain second magnetism indicator (59) therein. With clamp (72) being fixedly attached onto housing (12) by any suitable attachment means of engineering choice, such as glue, or the like.

As previously noted within the specification, the present invention is unique as it allows the user to completely magnetize or demagnetize, or partially magnetize or demagnetize a tool. Therefore, we further include various methods of use as follows:

1. A method for fully magnetizing a tool using a multipurpose magnetizer/demagnetizer comprising the steps of:
   a. inserting a typical plug (38) which extends from a multipurpose magnetizer/demagnetizer (10) into a typical wall electrical outlet;
   b. pushing a AC/DC rocker switch (18) into the DC position;
   c. grasping the handle of a tool (32) which is to be fully magnetized;
   d. inserting the entire tip of tool (32) into a receptacle (30) located on multipurpose magnetizer/demagnetizer (10);
   e. pressing an on/off switch (20) into the on position for approximately 1 to 2 seconds;
   f. releasing the on/off switch (20); and;
   g. removing the tip of tool (32) which is now fully magnetized from within receptacle (30).

2. A method for fully demagnetizing a tool using a multipurpose magnetizer/demagnetizer comprising the steps of:
   a. inserting a typical plug (38) which extends from a multipurpose magnetizer/demagnetizer (10) into a typical wall electrical outlet;
   b. pushing a AC/DC rocker switch (18) into the AC position;
   c. grasping the handle of a tool (32) which is to be fully demagnetized;
   d. inserting the entire tip of tool (32) into a receptacle (30) located on multipurpose magnetizer/demagnetizer (10);
   e. pressing an on/off switch (20) into the on position for approximately 1 to 2 seconds while slowly moving back and forth or in and out;
   f. releasing the on/off switch (20); and;
   g. removing the tip of tool (32) which is now fully demagnetized from within receptacle (30).

3. A method for partially magnetizing a tool using a multipurpose magnetizer/demagnetizer comprising the steps of:
   a. inserting a typical plug (38) which extends from a multipurpose magnetizer/demagnetizer (10) into a typical wall electrical outlet;
   b. pushing a AC/DC rocker switch (18) into the DC position;
   c. grasping the handle of a tool (32) which is to be fully magnetized;
   d. inserting just the tip of tool (32) into a receptacle (30) located on multipurpose magnetizer/demagnetizer (10);
   e. pressing an on/off switch (20) into the on position for approximately 1 second;
   f. releasing the on/off switch (20); and;
   g. removing the tip of tool (32) which is now partially magnetized from within receptacle (30).

4. A method for magnetizing small parts using a multipurpose magnetizer/demagnetizer comprising the steps of:
   a. inserting a typical plug (38) which extends from a multipurpose magnetizer/demagnetizer (10) into a typical wall electrical outlet;
   b. pushing a AC/DC rocker switch (18) into the DC position;

c. grasping and removing a non-conductive tube (40) from within a clip (56) located on the multipurpose magnetizer/demagnetizer (10);

d. removing the cap (42) from non-conductive tube (40);

e. inserting small parts which are to be fully magnetized into non-conductive tube (40);

f. replacing cap (42) onto non-conductive tube (40);

g. inserting the entire non-conductive tube (40) into a receptacle (30) located on multipurpose magnetizer/demagnetizer (10);

h. pressing an on/off switch (20) into the on position for approximately 1 to 2 seconds;

i. releasing the on/off switch (20);

j. removing non-conductive tube (40) from within receptacle (30);

k. removing cap (42) from non-conductive tube (40);

l. removing small parts from within non-conductive tube (40), which are now magnetized;

m. replacing cap (42) onto non-conductive tube (40); and;

n. inserting non-conductive tube (40) into clip (56).

5. A method for demagnetizing small parts using a multipurpose magnetizer/demagnetizer comprising the steps of:

a. inserting a typical plug (38) which extends from a multipurpose magnetizer/demagnetizer (10) into a typical wall electrical outlet;

b. pushing a AC/DC rocker switch (18) into the AC position;

c. grasping and removing a non-conductive tube (40) from within a clip (56) located on the multipurpose magnetizer/demagnetizer (10);

d. removing the cap (42) from non-conductive tube (40);

e. inserting small parts which are to be fully demagnetized into non-conductive tube (40);

f. replacing cap (42) onto non-conductive tube (40);

g. inserting the entire non-conductive tube (40) into a receptacle (30) located on multipurpose magnetizer/demagnetizer (10);

h. pressing an on/off switch (20) into the on position for approximately 1 second;

i. releasing the on/off switch (20);

j. removing non-conductive tube (40) from within receptacle (30);

k. removing cap (42) from non-conductive tube (40);

l. removing small parts from within non-conductive tube (40), which are now demagnetized;

m. replacing cap (42) onto non-conductive tube (40); and;

n. inserting non-conductive tube (40) into clip (56).

6. A method for using a magnetism indicator for determining the magnetic strength of a tool, comprising the steps of:

a. grasping a magnetism indicator (59);

b. inserting a tool (32) just partially into magnetism indicator (59) until spring (62) with attached slug (66) begins to move; and;

c. withdrawing tool (32) slowly from within magnetism indicator (59) which causes spring (62) with attached slug (66) to be urged toward tool (32), magnetism indicator (59) having indicia (70) thereon which signifies magnetic strength, such as indicia (70) includes a red zone (70-A) and a green zone (70-B), whereby, when spring (62) with attached slug (66) stops within red zone (70-A), the user is notified that tool (32) needs to be re-magnetized, while when spring (62) with attached slug (66) stops within green zone (70-B), the user is notified that tool (32) need not be re-magnetized.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described the invention what we claim as new and wish to secure by Letters Patent is:

What is claimed is:

1. A multipurpose magnetizer/demagnetizer which is used for magnetizing or demagnetizing ferromagnetic tools comprising: a housing; a first coil; a second coil; an alternating current direct current rocker switch; an on/off push switch; a safety fuse; and an indicator light; said first coil and said second coil being arranged in stacked series in such a manner as to create a synchronized magnetic field in the same direction, said safety fuse said indicator light and each said switch being fixedly surface mounted onto said housing, said housing forming an internal cavity for containment of each said coil and electrical interconnected components, said first coil and said second coil forming a central elongated opening, said housing having two openings, said two openings being opposed to each other, said central elongated opening and said two openings in combination forming an elongated circular receptacle for receiving a tool therein, and said housing having a hole for containment of a typical electrical wire with associated wall plug.

2. The magnetizer/demagnetizer of claim 1 wherein said alternating current direct current rocker switch is a double pole double-throw 115 VAC/4 amp.

3. The magnetizer/demagnetizer of claim 1 is further limited to said on/off push switch being a momentary single throw-double pole 4 amp.

4. The magnetizer/demagnetizer of claim 1 is further limited to said safety fuse being a 120 VAC/5 amp.

5. The magnetizer/demagnetizer of claim 1 is further limited to said indicator light being a neon lamp/resister package powered by 115 VAC.

6. The magnetizer/demagnetizer of claim 1 is further limited to said wall plug being a typical 115 AC 15 amp.

7. The magnetizer/demagnetizer of claim 1 wherein said electrical interconnected components include associated electrical lead lines, 4 diodes which when interconnected form a bridge rectifier circuit 400 v/4 amp, and a DC power off inductive kick surge suppressor.

8. The magnetizer/demagnetizer of claim 1 further includes an accessory item in the form of a tube, with said tube being of a shape and size to be slidably engaged within said elongated circular receptacle, and said cap having closure means in the form of a removable cap.

9. The magnetizer/demagnetizer of claim 8 further includes a clip fixedly mounted onto said housing, with said clip being of a shape and size to frictionally receive said tube therein.

10. The magnetizer/demagnetizer of claim 1 further includes a magnetism indicator means for exhibiting magnetic strength of said tool, said magnetism indicator means comprising: a metal strip which is coated with a paint having a molecular composition which changes color according to a magnetic field.

11. The magnetizer/demagnetizer of claim 1 further includes a magnetism indicator means for exhibiting magnetic strength of said tool, said magnetism indicator means comprising: a tubular housing which is made from a non-conductive material, said tubular housing having a first end and a second end, said first end of said tubular housing having attachment means for fixedly attaching a spring thereon, said spring having a first end and a second end, said first end of said spring being fixedly attached to said first end of said tubular housing, said second end of said spring being fixedly attached to a metal slug, and said tubular housing having indicia thereon for indicating magnetic strength.

* * * * *